US005474483A

United States Patent [19]

Sun

[11] Patent Number: 5,474,483

[45] Date of Patent: Dec. 12, 1995

[54] WHEELED TOY CONTAINER WITH SURFACE TO ATTACH BLOCKS

[76] Inventor: Jin R. Sun, No. 64, Lane 55, Chung Yi Road, Tu Cheng Hsiang, Taipei Hsien, Taiwan

[21] Appl. No.: 372,731

[22] Filed: Jan. 13, 1995

[51] Int. Cl.[6] ..... A63H 33/08

[52] U.S. Cl. ..... 446/71; 446/75; 446/117; 446/128; 446/431; 280/87.01; 280/87.05; 280/47.35

[58] Field of Search ..... 446/71, 75, 76, 446/77, 269, 431, 128, 117; 230/87.01, 87.05, 47.35

[56] References Cited

U.S. PATENT DOCUMENTS

| | | | |
|---|---|---|---|
| 288,662 | 11/1883 | Reed | 280/87.01 |
| D 355,763 | 2/1995 | Sun | D3/291 |
| 4,446,649 | 5/1984 | Moe et al. | 446/128 |
| 4,753,346 | 6/1988 | Tsuji | 446/75 |
| 4,850,092 | 7/1989 | Newarski | 446/75 |
| 5,028,060 | 7/1991 | Martin | 280/87.01 |
| 5,380,232 | 1/1995 | Berggreen et al. | 446/75 |

FOREIGN PATENT DOCUMENTS

| | | | |
|---|---|---|---|
| 2667512 | 4/1992 | France | 446/269 |
| 4211329 | 10/1993 | Germany | 446/71 |
| 2115299 | 9/1983 | United Kingdom | 446/431 |
| 9210255 | 6/1992 | WIPO | 446/75 |

*Primary Examiner*—Robert A. Hafer
*Assistant Examiner*—Jeffrey D. Carlson

[57] ABSTRACT

A multifunctional toy container including a hollow container body shaped like a motor vehicle and supported on wheels for keeping toy blocks, a handle fastened to the rear side of the container body for moving the container body on the ground by hand, and a top cover detachably covered on the container body and having a plurality of studs raised from the top side for mounting toy blocks to build up any of a variety of objects.

5 Claims, 10 Drawing Sheets

WHEELED TOY CONTAINER WITH SURFACE TO ATTACH BLOCKS

BACKGROUND OF THE INVENTION

The present invention relates to toy containers, and relates more particularly to a multifunctional toy container which can be used as a container for storing blocks, a baby carriage for carrying a child, as well as a base for building blocks.

Conventionally, paper boxes and iron drums are commonly used for storing blocks and toy accessories. Recently, there are several toy containers developed for use as a toy as well as a container. U.S. Design Pat. No. 350,284 discloses a toy container for storing blocks that can be carried by hand or moved to slide on a smooth surface. However, this toy container cannot be used as a seat for sitting, furthermore it has no push handle for a child to push the toy container by hand. U.S. Pat. No. Des 355,763, issued Feb. 28, 1995, discloses a toy box having raised portions on the top side of the cover thereof. Therefore, the cover can be used as a base for mounting the blocks, which are received in the toy box, to build up objects. However, this toy box cannot be used as a baby carriage and moved on the ground by hand. U.S. Des. Pat. No. 338,923 discloses a toy container having two wheels and a handle. This toy container can be carried on the ground by hand. However, because it is equipped with two wheels only, it can not be used as a baby carriage to carry a baby or young child. Furthermore, this toy container cannot be used as a base plate for mounting blocks to set up objects.

SUMMARY OF THE INVENTION

It is one object of the present invention to provide a multifunctional toy container which can be used as a container for keeping toy blocks as well as a toy vehicle for playing by children. It is another object of the present invention to provide a toy container which is covered with a detachably top cover that can be conveniently opened and can also be used as a base for mounting toy blocks to build up any of a variety of objects. It is still another object of the present invention to provide a multifunctional toy container which is shaped like a motor vehicle and supported on wheels so that it can be be moved on the ground as a baby carriage. According to the present invention, the multifunctional toy container comprises a hollow container body for keeping blocks which is shaped like a motor vehicle and equipped with wheels for moving on the ground, a handle fastened to the rear side of the container body for moving the container body on the ground by hand, and a top cover detachably covered on the container body and having a plurality of studs raised from the top side for mounting toy blocks to build up any of a variety of objects.

DETAILED DESCRIPTION OF THE PREFERRED EMBODIMENT

Figure 1:
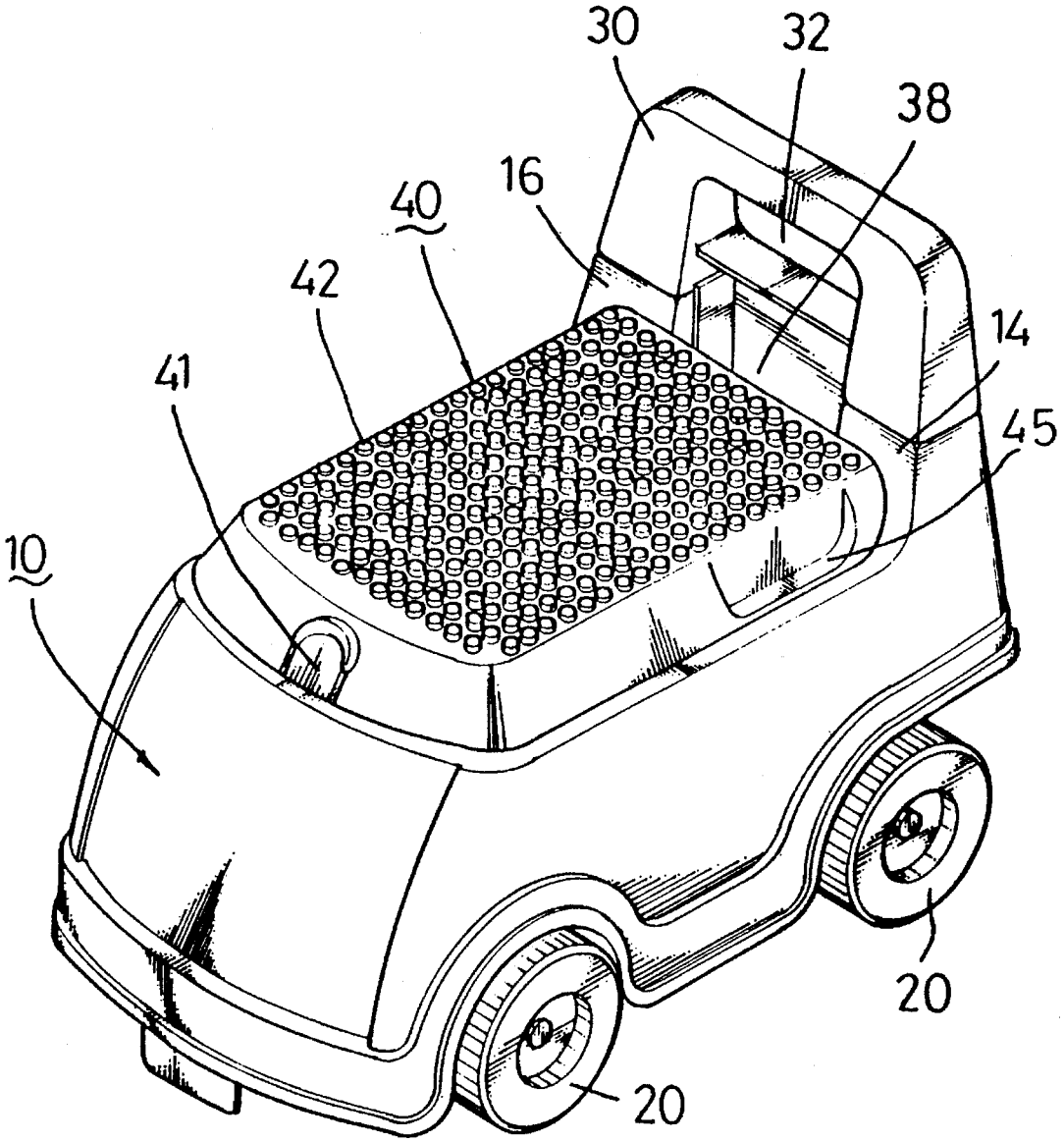
FIG. 1 is an elevational view of a multifunctional toy container according to the present invention.
Figure 2:
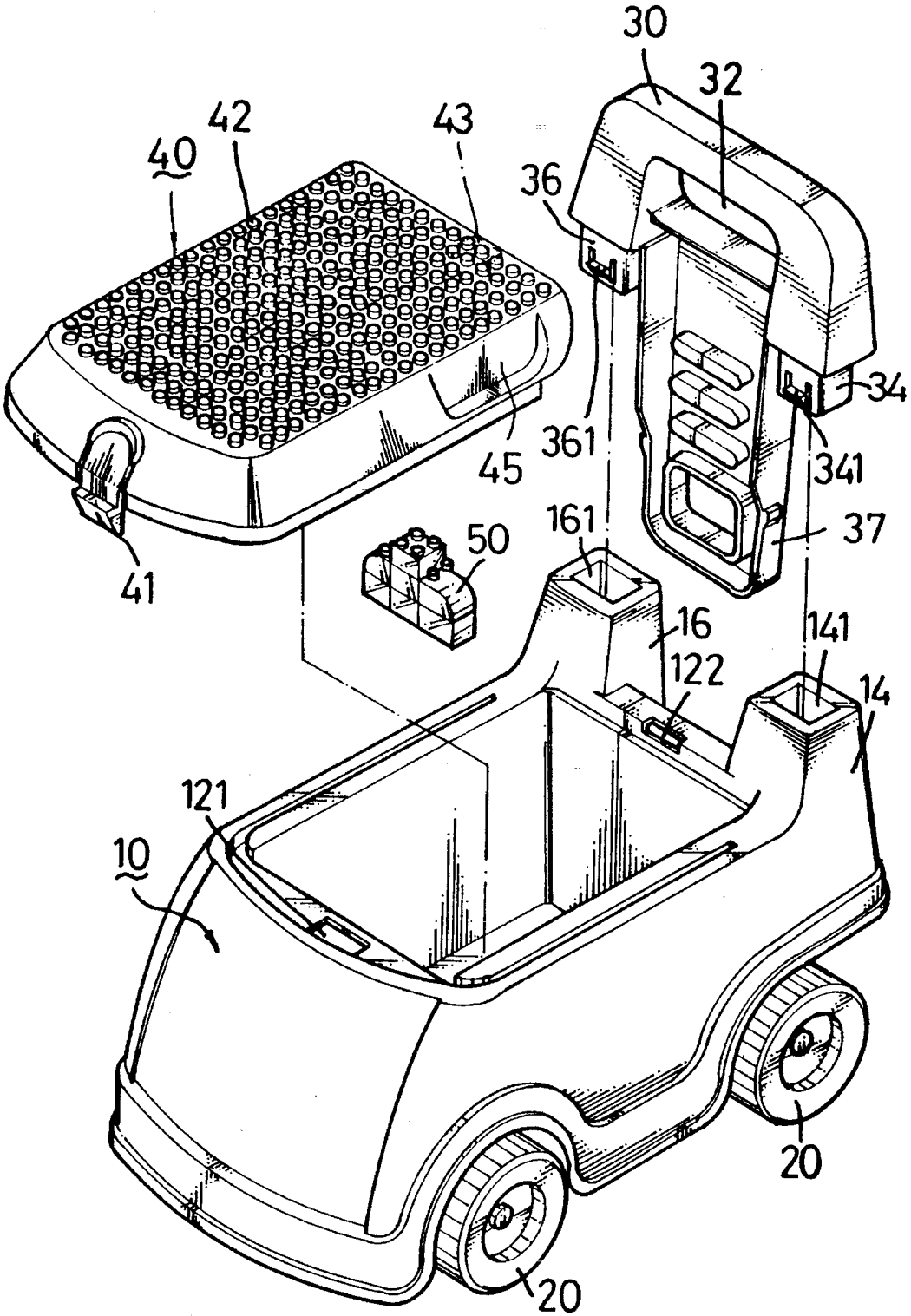
FIG. 2 is an exploded view of the toy container shown in FIG. 1.

Referring to FIGS. 1 and 2, a multifunctional toy container in accordance with the present invention is generally comprised of a container body 10, two pairs of wheels 20, a handle 30, and a top cover 40.

Figure 3:
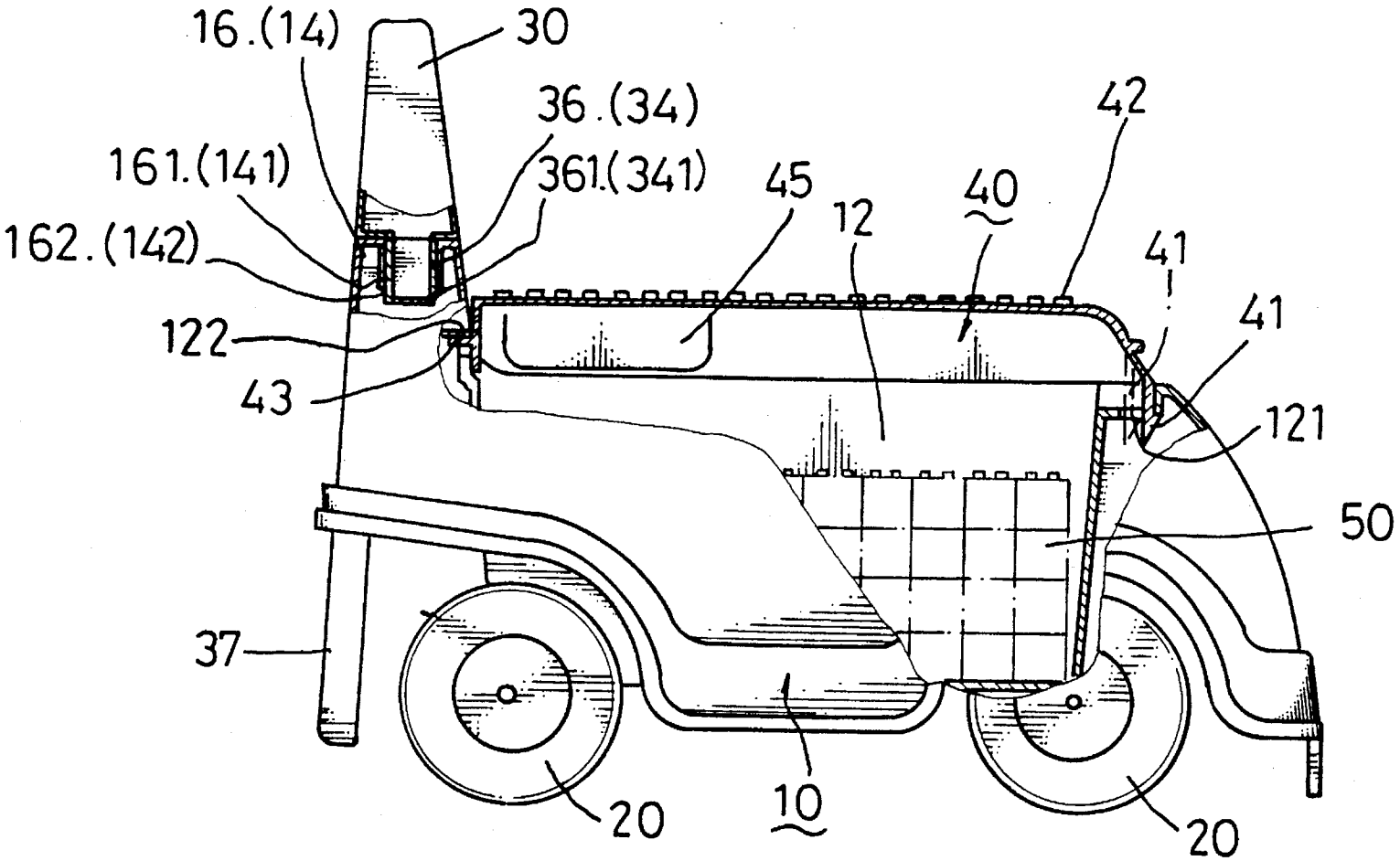
FIG. 3 is a side view in section of the toy container shown in FIG. 1.
Figure 4:
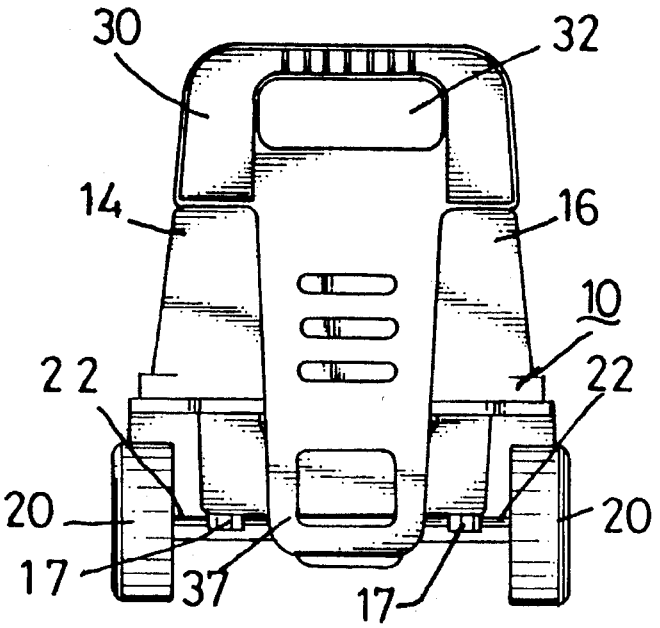
FIG. 4 is a rear view of the toy container shown in FIG. 1.
Figure 5:
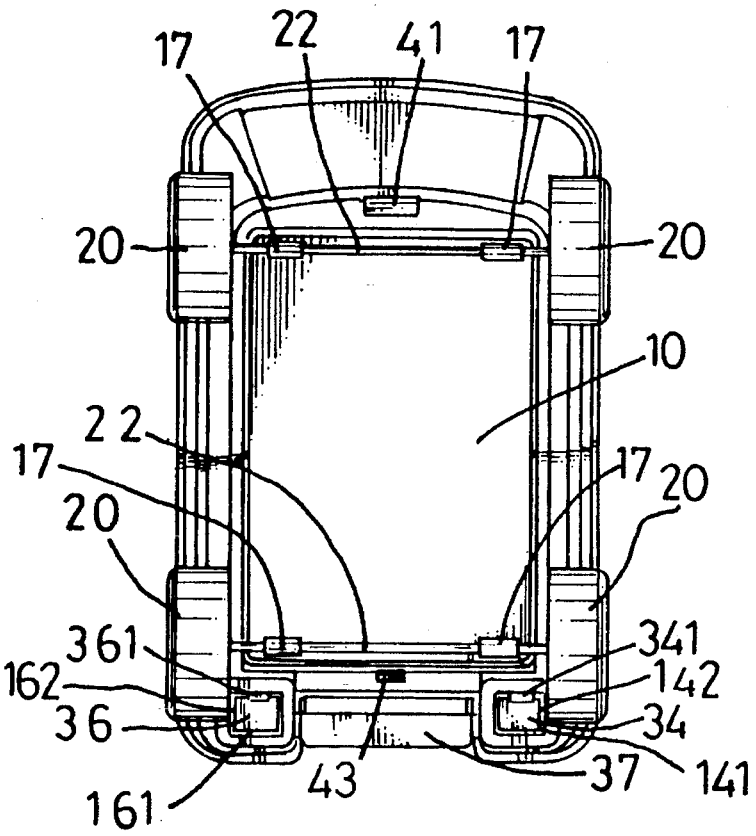
FIG. 5 is a bottom view of the toy container shown in FIG. 1.

Referring to FIGS. 3, 4 and 5, and FIG. 2 again, the container body 10 is shaped like a motor vehicle having a top open chamber 12 for keeping blocks 50, two upright supports 14 and 16 bilaterally raised from the top of the back side, each upright support comprising a top mounting hole 141 or 161 and a retaining hole 142 or 162 inside the top mounting hole 141 or 161 for mounting the handle 30 (see FIG. 3), a rear plug hole 122 disposed at the top of the back side between the upright supports 14 and 16, a front hook hole 121 disposed at the top of the front side opposite the rear plug hole 122, two symmetrical pairs of wheel axle housings 17 mounted on the bottom side, two wheel axles 22 supported on the wheel axle housings 17 to hold the wheels 20 (see FIG. 5). The handle 30 comprises a hand-hold portion 32 transversely disposed at the top, a bottom extension rod 37 (see also FIG. 11) extended from the middle of the bottom side of the hand-hold portion 32, two downward coupling rods 34 and 36 extended from two opposite ends of the hand-hold portion 32 and respectively inserted into the top mounting holes 141 and 161 of the upright supports 14 and 16, each downward coupling rod 34 or 36 having a springy hook 341 or 361 respectively hooked in the retaining holes 142 and 162 inside the top mounting holes 141 and 161. The top cover 40 comprises a plurality of studs 42 raised from the top side for building the blocks 50, a front springy hook 41 and a rear retainer rod 43 respectively fastened to the front hook hole 121 and the rear plug hole 122.

Figure 10:
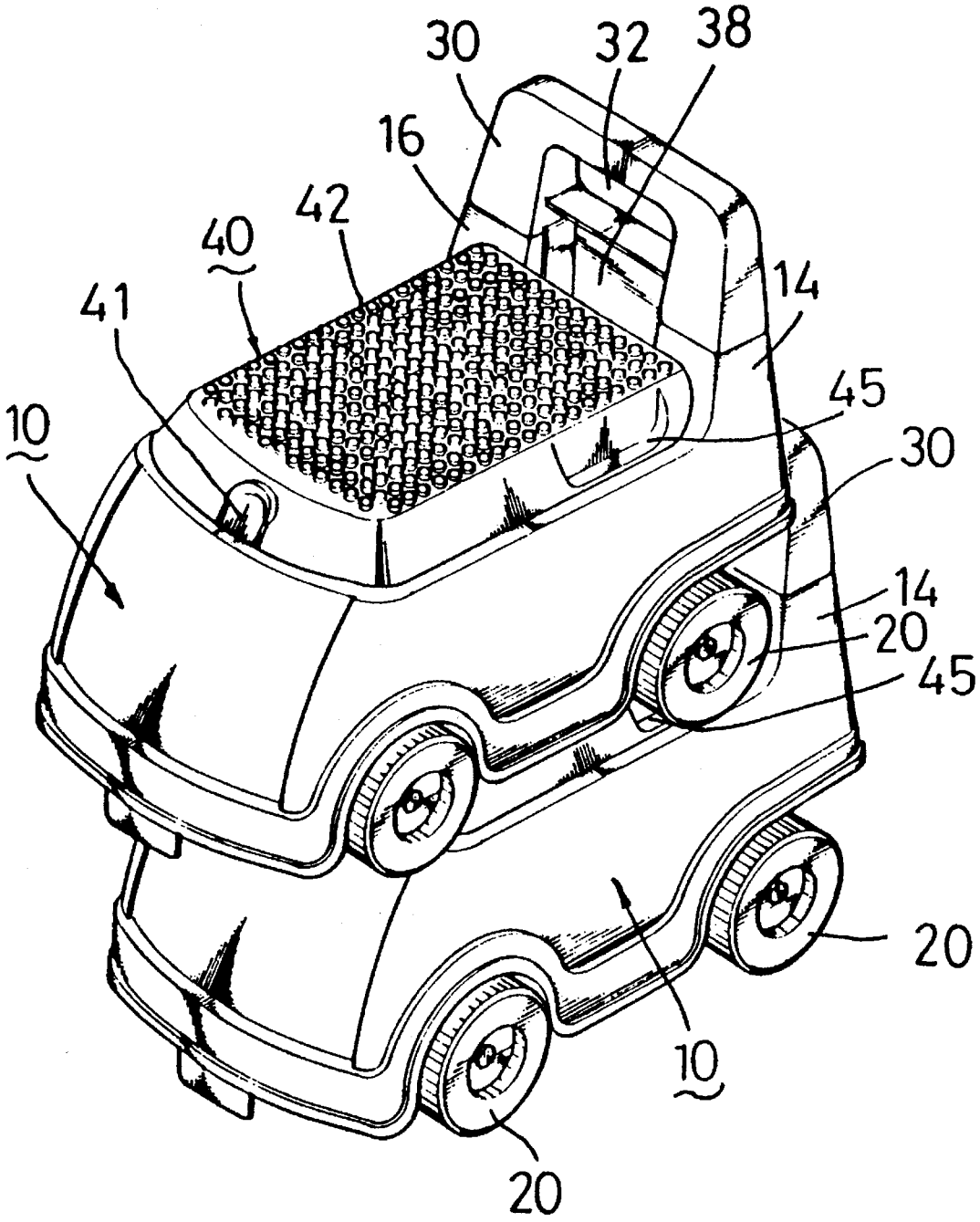
FIG. 10 shows two toy containers arranged in a stack according to the present invention.
Figure 11:
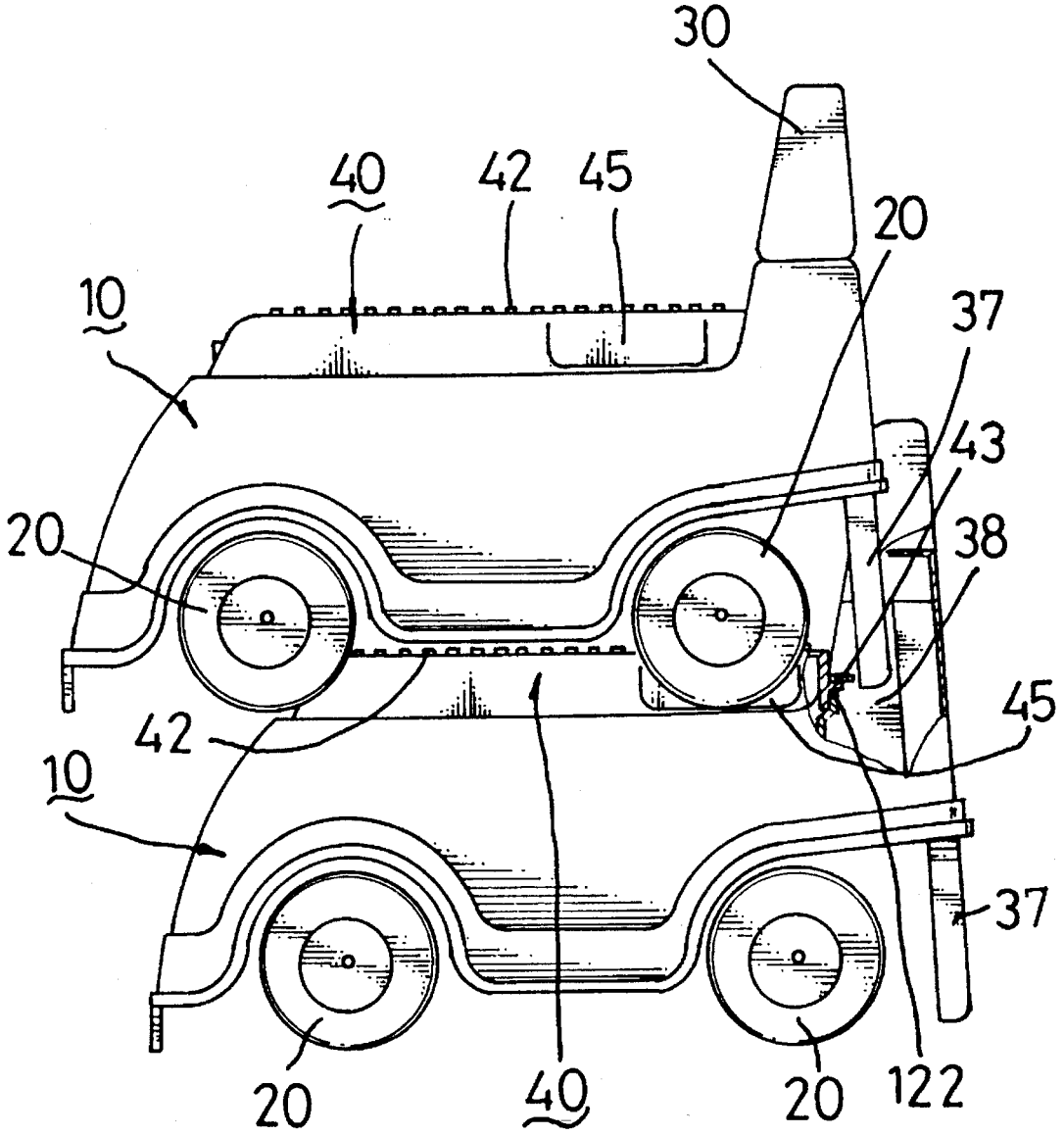
FIG. 11 is a partial view in section of FIG. 10.

Referring to FIG. 10 and 11, the top cover 40 further comprises two recessed holes 45 at two opposite lateral sides; a vertical space 38 is defined between the handle 30 and the back side of the container body 10. When two multifunctional toy containers are arranged in a stack, the two rear wheels 20 of the upper toy container can be received in the two recessed holes 45 on the top cover 40 of the lower toy container and, the bottom extension rod 37 of the handle 30 of the upper toy container can be received in the vertical space 38 defined between the handle 30 and the back side of the container body 10 of the lower toy container.

Figure 7:
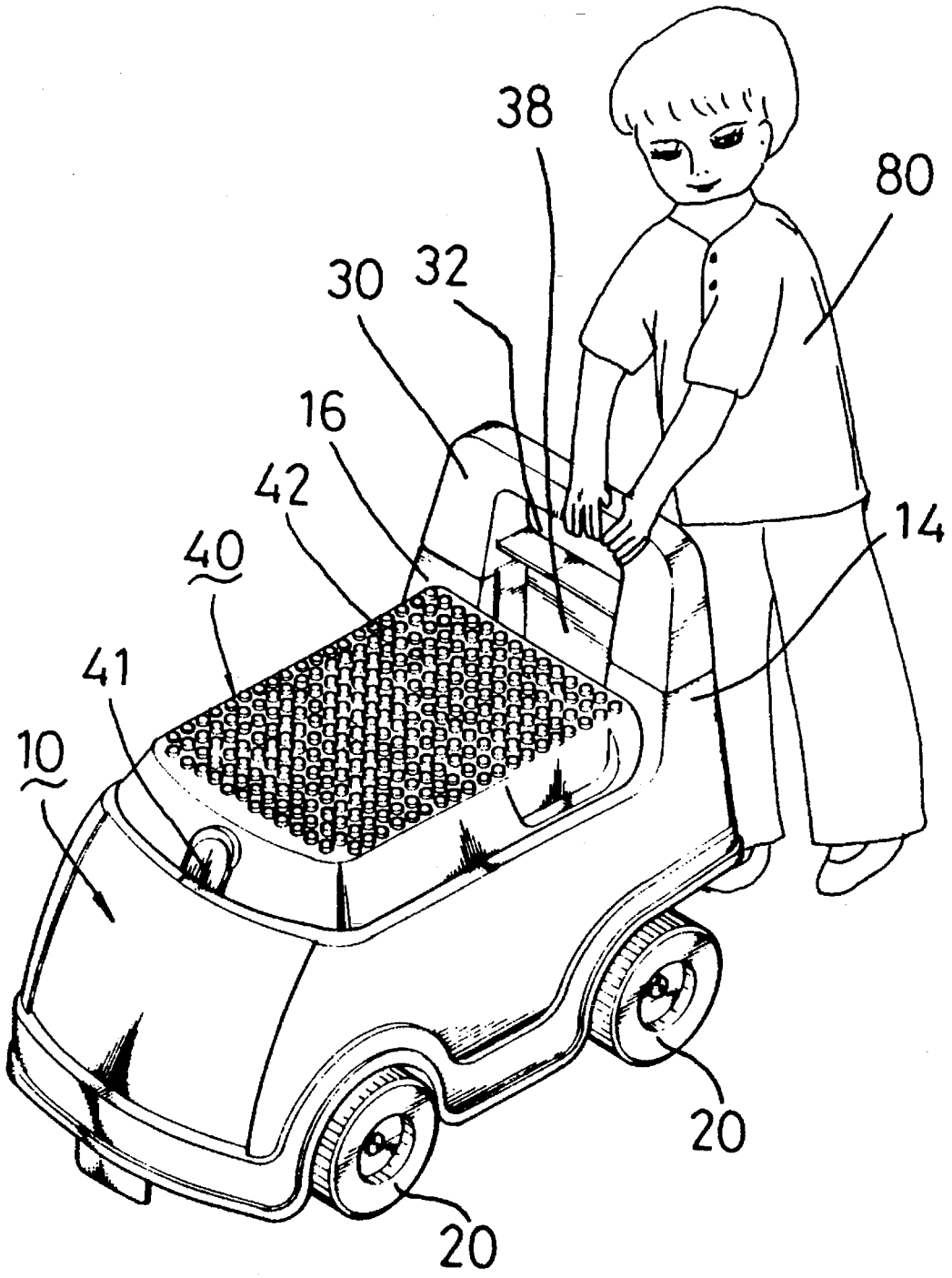
FIG. 7 shows the toy container of FIG. 1 used as a baby carriage and pushed by a child.
Figure 8:
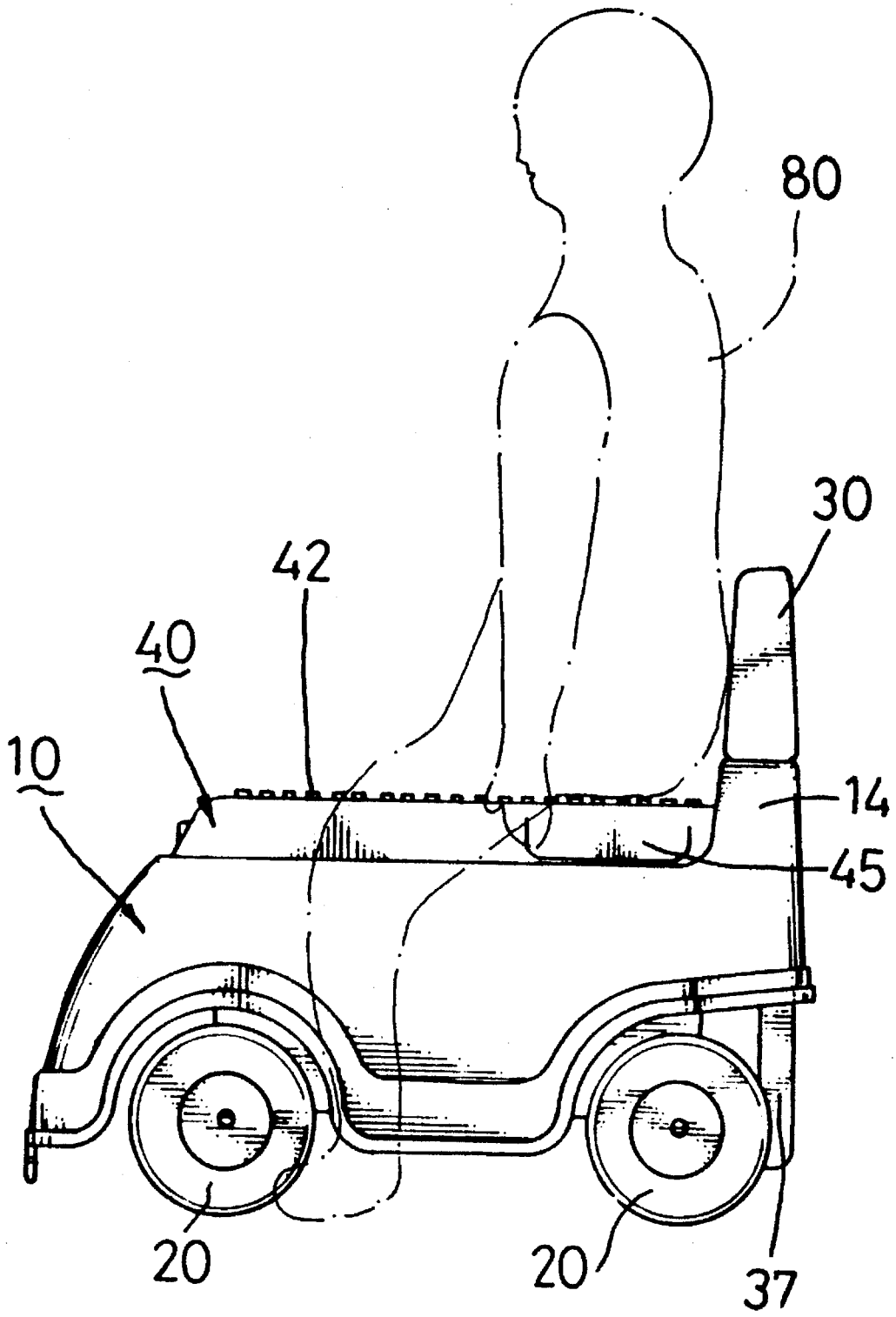
FIG. 8 shows a child sitting on the top cover of the toy container of FIG. 1 in one direction.
Figure 9:
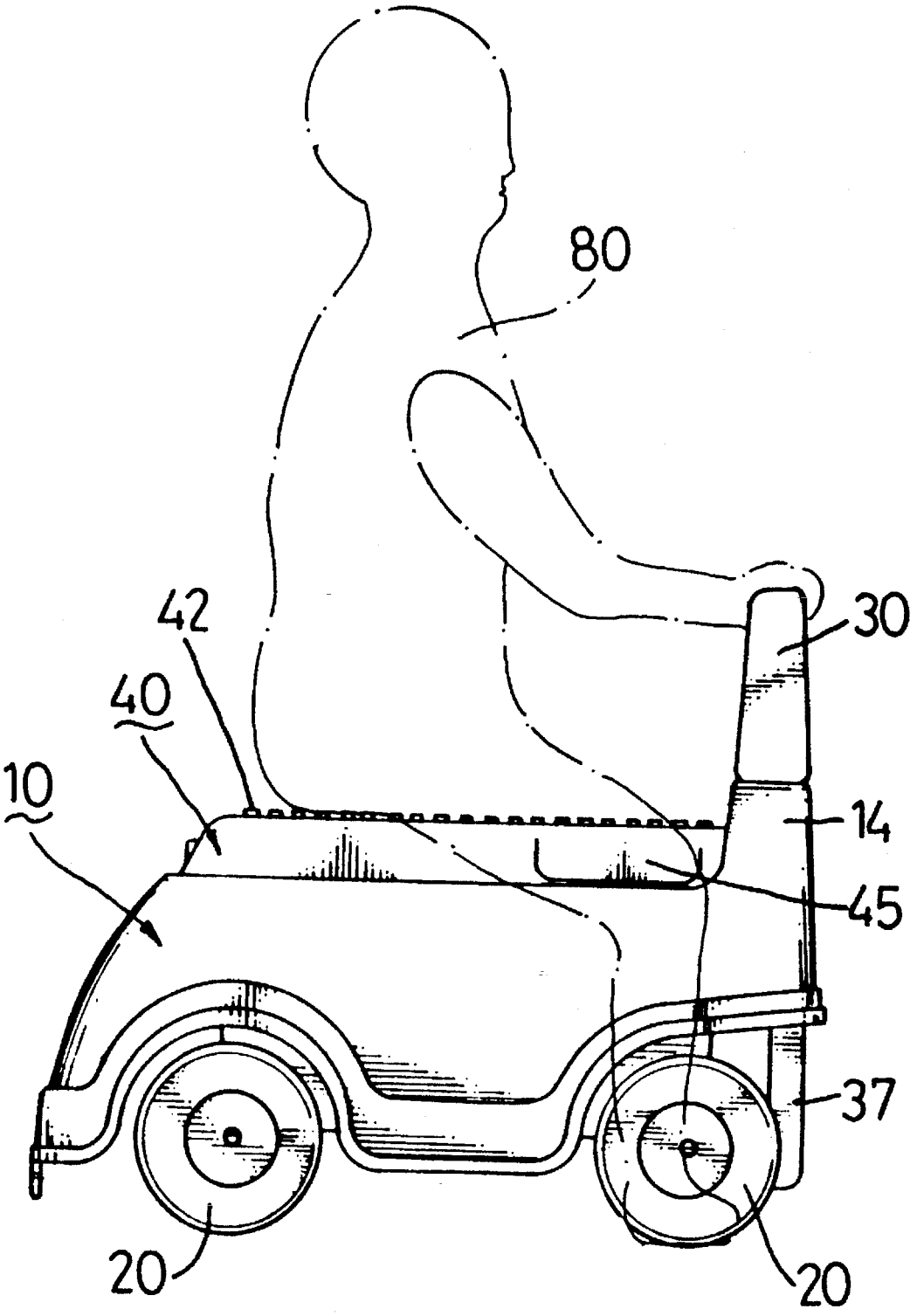
FIG. 9 shows the child sit on the top cover of the toy container of FIG. 1 in the reversed direction.

Referring to FIGS. 7, 8, and 9, the toy container can be used as a baby carriage for pushing, sitting or playing by a child 80.

Referring to FIG. 3 again, the top cover 40 can be easily removed from the container body 10 by pressing the front springy hook backwards from the front hook hole 121.

Figure 6B:
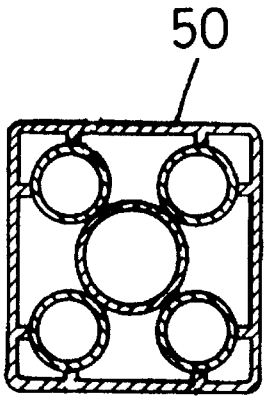
FIG. 6 shows the toy container of FIG. 1 used as a base for building blocks.
FIG. 6A is a cross section view along line 6A in FIG. 6.
Figure 6A:
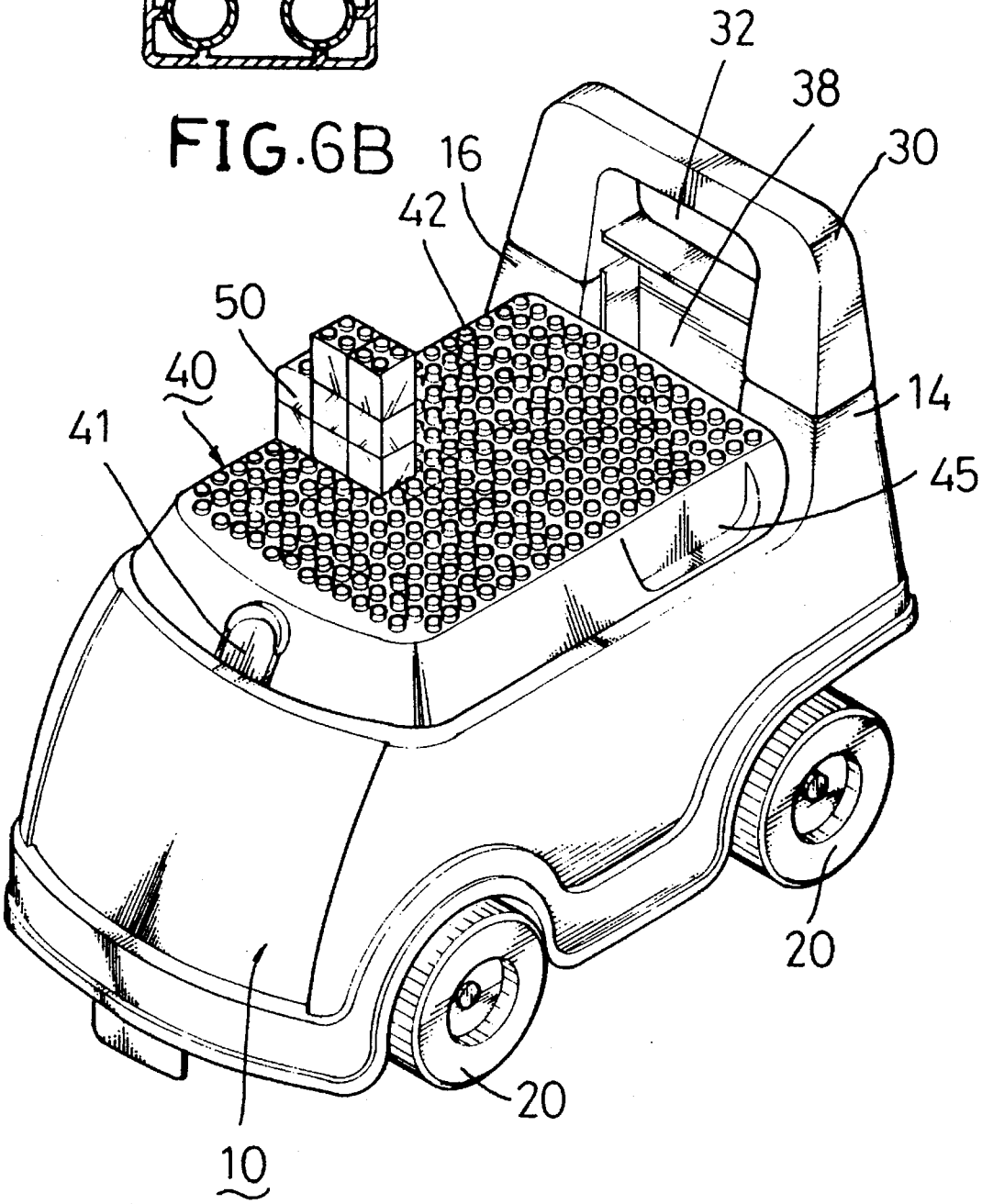

Referring to FIG. 6, the toy container can be used as a base for building the blocks 50 on the studs 42 of the top cover 40.

What is claimed is:

1. A multifunctional toy container comprising:

a container body shaped like a motor vehicle having a top open chamber for keeping blocks, two upright supports bilaterally raised from the topmost edge of a back side of said container body, each upright support comprising a top mounting hole and a retaining hole inside said top mounting hole, a rear plug disposed at the top of said back side between said upright supports, a front hook hole disposed at the topmost edge of a front side of said container body opposite said rear plug hole, two symmetrical pairs of wheel axle housings mounted on a bottom side of said container body, two wheel axles supported in said wheel axle housings receiving a pair of front wheels and a pair of rear wheels;

a handle fastened to the back side of said container body, said handle comprising a transverse hand-hold portion, a bottom extension rod extended from the middle of said transverse hand-hold portion, two downward coupling rods respectively extended from two opposite ends of said hand-hold portion and inserted into said top mounting holes of said upright supports, each downward coupling rod having a springy hook respectively hooked in the retaining holes inside said top mounting holes; and a top cover covering said top open chamber, said top cover comprising a front springy hook and a rear retainer rod respectively fastened to said front hook hole and said rear plug hole of said container body.

2. The multifunctional toy container of claim 1 wherein said top cover further comprises two recesses at two opposite sides and the back side of said container body defines with said handle a vertical rear space such that when two multifunctional toy containers are stacked one above the other, the pair of rear wheels and bottom extension rod of the handle of the upper toy container can be received in the recesses and the vertical rear space respectively on the lower toy container.

3. The multifunctional toy container of claim 1 wherein said handle can be pushed by hand to move said container body on the ground, and said top cover can be used as a seat for a child to sit on.

4. The multifunctional toy container of claim 1 wherein said top cover can be removed from said container body by pressing said front springy hook backwards from said front hook hole.

5. The multifunctional toy container of claim 1 wherein said top cover comprises a plurality of studs raised from a top side thereof for mounting toy blocks to build up objects.

* * * * *